US007496426B2

(12) United States Patent
Theilacker

(10) Patent No.: US 7,496,426 B2
(45) Date of Patent: Feb. 24, 2009

(54) METHOD FOR CONTROLLING THE CUT REGISTER IN A WEB-FED ROTARY PRESS

(75) Inventor: Klaus Theilacker, Friedberg-Rederzhausen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 510 days.

(21) Appl. No.: 11/255,557

(22) Filed: Oct. 21, 2005

(65) Prior Publication Data

US 2006/0102027 A1 May 18, 2006

(30) Foreign Application Priority Data

Oct. 23, 2004 (DE) ..... 10 2004 051 633

(51) Int. Cl.
*B41F 13/56* (2006.01)
*B41F 13/54* (2006.01)
*G06F 19/00* (2006.01)

(52) U.S. Cl. ..... 700/125; 101/224; 101/225; 101/226; 101/227; 101/228

(58) Field of Classification Search ..... None
See application file for complete search history.

(56) References Cited

U.S. PATENT DOCUMENTS 4,452,140 A 6/1984 Isherwood et al.
5,740,054 A 4/1998 Dürr et al.
5,924,362 A * 7/1999 Volz et al. ..... 101/183
6,338,707 B1 * 1/2002 Michalik ..... 493/357
6,601,506 B2 * 8/2003 Dauer ..... 101/248
7,114,440 B2 * 10/2006 Theilacker ..... 101/227
2003/0084765 A1 * 5/2003 Elkotbi et al. ..... 83/13
2006/0230968 A1 * 10/2006 Brandenburg et al. ..... 101/485
2006/0249043 A1 * 11/2006 Brandenburg et al. ..... 101/485

FOREIGN PATENT DOCUMENTS

DE 42 25 122 2/1994
DE 199 10 835 9/2000
DE 199 36 291 3/2001
DE 42 38 387 2/2004
DE 103 07 202 9/2004
DE 103 55 122 6/2005

OTHER PUBLICATIONS

Search Report dated May 4, 2006 issued for the corresponding German Application No. 10 2004 051 633.2.

* cited by examiner

*Primary Examiner*—Albert DeCady
*Assistant Examiner*—Sunray R Chang
(74) *Attorney, Agent, or Firm*—Cohen Pontani Lieberman & Pavane LLP

(57) ABSTRACT

A method for controlling the cut register in a web-fed rotary press, includes registering an actual value measurement of a position of cut register marks on a printed material web by measuring positions of printing cut register marks on the printed material web, using the measured positions in control loops as actual values of positions of cuts for cut register control, and correcting a first set value of a cut register setting element assigned to the printing material web based on a mathematical model for an error contribution of a proportion of the path of the printing material web that is not registered by the actual value.

38 Claims, 7 Drawing Sheets

METHOD FOR CONTROLLING THE CUT REGISTER IN A WEB-FED ROTARY PRESS

BACKGROUND OF THE INVENTION

The invention relates to a method for controlling the cut register in a web-fed rotary press and a computer program for cut register control.

DE 199 36 291 A1 describes a method for determining the positions of cuts of part webs of a longitudinally cut printing material web in a web-fed rotary press, in which the part webs are combined into strands, these are each folded on a former and are finally crosscut by a knife cylinder. In a departure from the aforementioned document, here the cut individual web halves are designated part webs and the cut webs combined after the former are designated strands. The positions of the cuts determined are used to control the cut register, a dedicated control loop being provided for each part web and, in addition, an outer control loop for the already folded strand. The intention is to make it possible to keep the positions of the cuts of all the part webs of each folded strand at a desired value in each case.

Such a control system with a cascade structure is complicated and in particular requires a large number of sensors to register the actual values of the positions of the cut on the individual part webs and also on each folded strand. This is not only costly but as the number of sensors used rises, the probability of failure of the cut register control also increases, since failures of automated systems are generally caused to a predominant extent by sensor failures.

Furthermore, the position of the cut after the folding can be registered with conventional optical means only by using a mark on the respective outer part web of each strand. A displacement of the position of the cut of the inner part webs between the folding former and the knife cylinder can no longer be measured, for which reason the aforesaid cascade control system of the position of the cut of a strand is based on the assumption that a displacement of the position of the cut taking place after the folding has the same extent in all part webs of a folded strand.

SUMMARY OF THE INVENTION

An object of the present invention is to provide a method for controlling the cut register in a web-fed rotary press that minimizes the cut register error, i.e., the deviation of the position of the cut from a predefined desired value, in the most simple, cost-effective and reliable manner with high accuracy.

The object is achieved by a method and a computer program for controlling a cut register in a web-fed rotary press, wherein a plurality of printing material webs are combined into one strand which is cross cut and folded in the web-fed rotary press, the method comprising the steps of measuring a position of a cut register mark on a printed material web and thereby registering an actual value measurement of the position of the cut register mark on the printed material web, using the registered position in a control loop as an actual value of the positions of the cut register mark for cut register control, and correcting, in the control loop, a first set value of a cut register setting element assigned to the printing material web based on a mathematical model to approximately compensate for an error contribution of a proportion of the path of the printing material web that is not registered by the actual value measurement. The first set value is the value necessary to achieve a control difference of zero and the control difference is the difference between the measured actual value of the position of the cut and a desired value of the position of the cut.

The object is also achieved by a method and a computer program for controlling a cut register in a web-fed rotary press, wherein a plurality of printing material webs are combined into one strand which is cross cut and folded in the web-fed rotary press, the method comprising the steps of measuring a position of a cut register mark on a first printed material web of the plurality of printed material webs and registering the actual value measurement of the position of the printing cut register mark on the first printed material web, using the measured position of the cut register mark in a control loop as an actual value of the position of the cut register mark for cut register control of the first printing material web, and calculating, from the registered position of the cut register mark, the actual value of a second printing material web of the plurality of printing material webs for the cut register control of the second printing material web based on a mathematical model which takes into account the differences in the paths of the plurality of printing material webs through the press.

A first basic embodiment of the invention is based on the finding that, in a web-fed rotary press, the contribution of the turner unit and the folding unit to the cut register error, therefore to the displacement of the position of the cut with respect to its desired position, in relation to the contribution of the other units of the press, can be predicted. In particular in the controlled case it can be assumed that the contribution to the cut register error arising in the aforesaid units has approximately a fixed relationship with the contributions arising in the other units of the press.

At least on the webs located in the interior of a strand, for the last time shortly before the combining to form a strand at the start of the folding unit, the position of a cut register mark can be measured. According to the present invention, therefore, by using a measured value registered at this point of the position of a cut register mark, the position of a cut of a printing material web or part web with which the measured value is associated is predicted, to approximately simulate the behaviour of a fictional control loop in which the actual value for forming the control difference for each web would have been registered directly on the knife cylinder.

To this end, when determining the set value of a cut register setting element assigned to a printing material web, that set value which would be necessary in order to achieve a control difference of zero between a measured actual value associated with the respective printing material web and a predefined desired value of the position of the cut is corrected on the basis of a mathematical model for the error contribution of a proportion of the path of the printing material web in the press that is not registered by the actual value measurement, such that the aforesaid error contribution is at least approximately compensated for. This set value is also called the first set value in the following text. In this case, a linear relationship between the registered and the non-registered error contribution is primarily suitable for the mathematical model.

A preferred procedure consists in correcting the control difference of a respective cut register control loop, resulting on the basis of the aforesaid measured value, in that, in the respective control loop, a control correction value is added to the control difference between the measured actual value and a predefined desired value of the position of the cut, the said value being calculated by multiplying the difference between the uncorrected control difference and a corrective term, derived from the instantaneous set value of the cut register setting element, with a fixed correction factor.

Such a correction can be carried out very simply in signal processing terms and, therefore, as compared with a cut register control system in which the position of a cut register mark before the formation of the strand is controlled without taking any account of the subsequent influence of the folding unit on the position of the cut, is associated with only a very small additional expenditure on operations. In particular, it requires no additional sensors for measuring the position of a cut register mark on the outer web of an already folded strand.

On the assumption that the disruptive effects which cause the cut register error in each case supply an amount per unit length of the path which is approximately constant on average within the individual units of a press, there is a functional relationship between the error contributions of the individual units, which incorporate the lengths of the paths of the printing material within the individual units. Given the same error contribution per unit length in the aforesaid machine, the error contribution of each unit is proportional to the path length of the printing material in the respective unit.

Therefore, a preferred embodiment of the invention provides for the value of the correction factor to depend on the ratio of the path length of the printing material web between the measurement location of the cut register mark and the location of the cross-cut and the path length of the printing material web between the press unit and the measurement location of the cut register mark, and preferably corresponds at least approximately to this ratio. The aforesaid path lengths in each press are known, as technical specification data.

The subtraction of a corrective term is used for the purpose of ensuring a stable response of the control loop in spite of the manipulation of the control difference. To this end, the corrective term used is the difference between the instantaneous set value of the cut register setting element and a reference value, an expedient reference value being the set value of the cut register setting element at which, following the last change in the predefined desired value, the control difference reached the value zero for the first time. This criterion for defining the reference value can be evaluated automatically without difficulty. In addition, the operations for forming the corrective term require only little additional effort.

The cut register setting element used can be the press unit in which the printing material is printed, in that the rotational speed of the impression cylinders is changed for some time in order to adjust the cut register. However, the method according to the invention can be applied equally well to presses in which setting elements of another type are provided on their own or in addition to the press unit for the purpose of cut register setting. In the event of a change in the rotational speed of the impression cylinders of a press unit, it is expedient to change the rotational speed of the driven cylinders of all the following clamping points of the printing material web originating from this press unit simultaneously in such a way that, overall, the result is the same change in the circumferential speed. This achieves the situation where the adjustment of the cut register is propagated substantially more quickly then at the web running speed, specifically at approximately the speed of sound in the printing material, which shortens the reaction time of the respective cut register control loop enormously.

In a press, generally, the invention permits compensation for an unmeasured contribution to the cut register error. This in no way relates just to the folding unit but in particular also to the turner unit. In the case of application to the turner unit, the cut register setting of a turned part web with respect to a straight-ahead part web originating from the same printing material web is corrected on the basis of a mathematical model for the error contribution of the additional path of the turned part web in the turner unit. In this way, separate measurement and control of the turned part web is rendered superfluous, which represents a considerable saving in effort. For the error contribution of the additional path of the turned part web, a linear model is primarily suitable.

The invention can also be used in a folding unit having a plurality of former levels. In this case, the correction of the cut register setting of a printing material web depends on the former level at which the printing material web runs into the folding unit.

A second basic embodiment of the invention is based on the finding that, in a web-fed rotary press, given knowledge of the exact cut register error of a single printing material web, conclusions about the cut register error of the other webs are possible by using the courses of the paths of the various webs, that is to say, by using the measurement of the cut register error of a single web, those of the other webs are predictable with a certain accuracy, which is sufficient in many cases, on the basis of a mathematical model.

Such a mathematical model preferably incorporates the different path lengths of the individual webs as parameters, to be specific, in the simplest case, in the form of a linear relationship between the cut register error of the measured web and that of another, unmeasured web.

The use of the press unit as a cut register setting element and taking account of the former level in relation to a correction of the respective set value of the cut register is possible in the same way in the second basic embodiment of the invention as in the first embodiment.

The particular advantage of the second basic embodiment of the invention is that it requires very little effort and can therefore be implemented cost-effectively, since it needs only a single cut mark sensor with associated signal processing electronics for the entire press, which, as compared with the cut mark measurement on each individual web or part web, means an enormous reduction in the scope of the sensors and the signal processing electronics connected downstream, and therefore an enormous saving in costs. It goes without saying that, with the omission of an individual measurement on each web, a potential greater residual error has to be accepted. For applications which do not have excessively high accuracy requirements, the accuracy of the control can, however, nevertheless be sufficient.

A further embodiment of the present invention is based on the finding that, given a constant operating speed of a press, the position of a cut remains virtually constant and therefore, for a predefined speed, a sufficient accuracy of the position of the cut can even be achieved with a static setting of the cut register, that is to say in theory even without cut register control. In the case of speed changes, that is to say in particular when running up from the setup speed to the continuous printing speed and when returning to the setup speed in the course of running down the printing operation, a comparatively large dynamic cut register error occurs. However, for a predefined time curve of the operating speed, this dynamic cut register error has a characteristic time curve, which can be reproduced well given otherwise constant operating parameters of the press.

According to the invention, therefore, in addition to the cut register control explained, a predetermined speed function, which describes a time variation of the operating speed of the press starting from a predetermined initial value, is assigned a cut register function which describes a time variation of a further set value of the cut register. In the event of a variation in the operating speed of the press according to the predetermined speed function, this second set value of the cut register is changed continuously and synchronously in accordance with the associated cut register function. In this case, the cut register function is chosen empirically such that it counteracts a change in the actual value of the cut position as a result of the change in the operating speed. The second set value is available to the cut register control system to determine the first set value, so that part of the control error determined can already be compensated for in advance. Consequently, according to this embodiment of the invention, only a residual error has to be corrected by means of the first set value, as a result of which faster cut register control is available.

On the assumption that a press represents an approximately linear system in relation to the cut register, the cut register function used can be the negative value of a function which describes the time variation of the actual value of the cut position with respect to the value present at the predetermined initial value of the operating speed of the press for the case in which a variation in the operating speed is carried out in accordance with the predetermined speed function, keeping the set value of the cut register constant.

Such a function can be determined by measurements, for example by the operating speed being changed in accordance with the speed function of interest for the real operation and, in the process, the actual value of the cut position with a constant cut register setting being measured by measurements, either manually by using sample copies removed or by sensors using suitable marks on the printing material. For the purpose of simplification, a mathematical approximation function for the curve determined by measurement can then be used as a cut register function.

In this case, it is advantageous to store at least some of the parameters of such an approximation function in a memory in such a way that they can be indicated to the operator of the press and can be changed manually by the operator to provide the possibility that, given the occurrence of a drift of the cut position in the course of successive printing processes, suitable adaptation of the cut register function can be carried out. The use of a mathematical approximation function, whose shape can be varied by a few adjustable parameters, is of great advantage from this point of view.

It is typical of the real printing operation that a variation in the operating speed does not run irregularly or randomly but that the time curve of the speed is subdivided into various characteristic sections. These sections are then also assigned characteristic sections of the cut register function.

In particular, a real speed function generally starts from a phase of constant initial speed, which is followed successively by a rise in the speed with a constant rate of rise, constancy of the speed over an interval of variable length but predetermined minimum length, and a fall in the speed at a constant rate of fall. A phase of constant final speed generally terminates the speed function.

In this case, the associated cut register function has a constant first value during the constant starting phase of the speed function. During the constant phase of higher speed, it reaches a constant second value. In the rise phase of the speed, the cut register function has a curved course, which can contain a maximum whose magnitude exceeds the constant second value. This results from a characteristic peak in the cut register error, which is to be observed in the case of a linear rise in the speed in the case of a constant cut register setting.

The cut register function belonging to the speed function previously described, which has a constant first value during the constant starting phase of the speed function, not only reaches a constant second value during the constant phase of higher speed but also a constant third value during the constant end phase of the speed. In the phase of falling speed between the constant second value and the constant third value, it then runs approximately linearly.

If a press has a number of setting elements for cut register setting, as is the case in newspaper presses, in which a number of webs printed simultaneously are combined to form a single product, then each of these setting elements can be assigned an individual cut register function, to compensate for different effects of a speed change of the machine as a result of different web guidance and path lengths of the individual webs or the part webs and strands produced therefrom by longitudinal cutting and folding within the context of what is possible.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
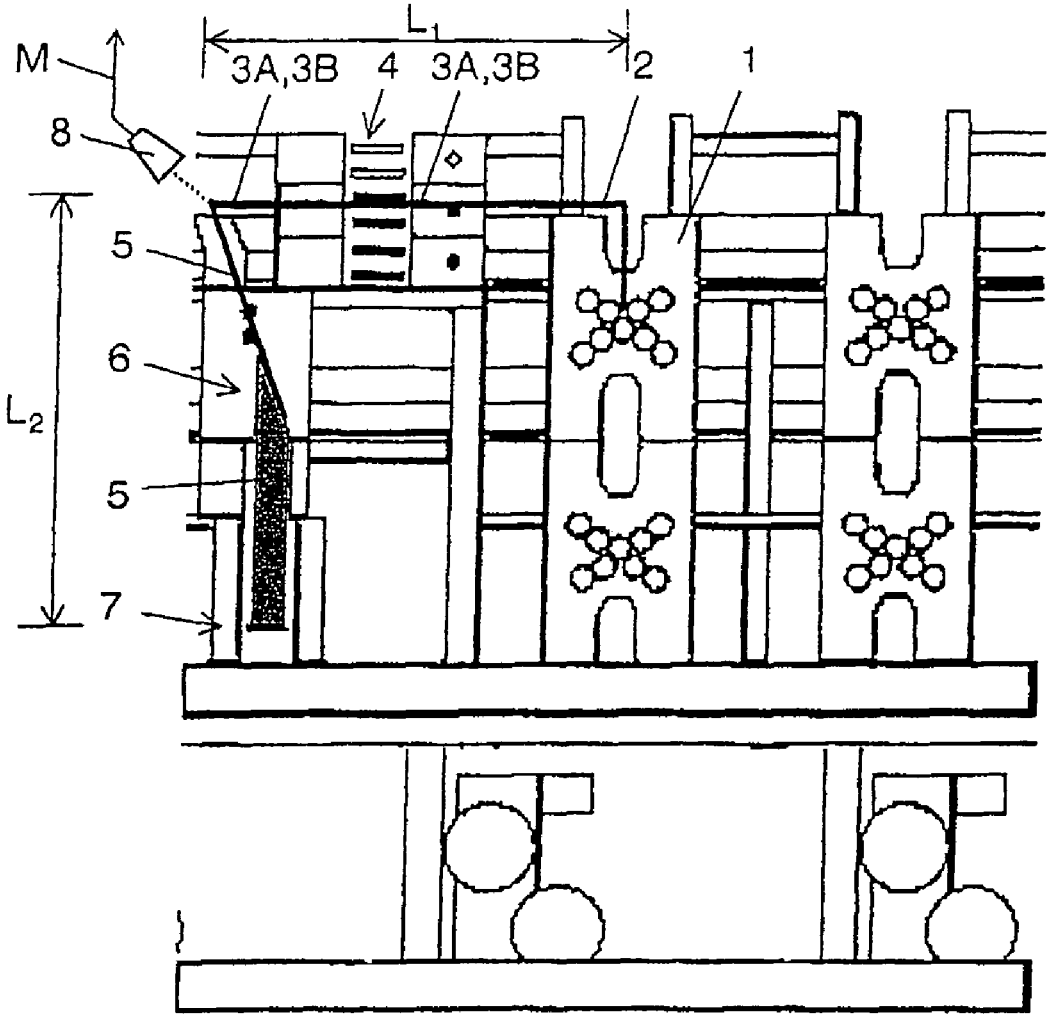
FIG. 1 is a schematic side view of a press having two press units.

A brief overview of the path of a printing material in a press is shown in FIG. 1, to the extent to which it is important for the present invention. As FIG. 1 shows, a press normally has a plurality of press units, wherein each of the press units prints on a printing material web. In FIG. 1, for the purpose of simplification, only the web 2 printed in the press unit 1 is illustrated after leaving the press unit 1.

The web 2, like the webs coming from the other press units, is first of all cut longitudinally into two part webs 3A and 3B. Only one part web 3B of the two part webs 3A and 3B is turned in a turner unit 4, before the two part webs 3A and 3B are combined with other part webs coming from other press units but not illustrated to form a strand 5 and the latter is folded at a former 6. As a result of the folding at the former 6, the strand 5 is rotated through 90° and then runs to a knife cylinder 7, where it is cross-cut into individual sections. In the process, the position of the cut has to be coordinated with the position of the printed image, to maintain a constant, predetermined spacing of the printed image from the cut edges in the longitudinal direction.

To set the cut register, i.e., position the cut in relation to the printed image, the web 2 or the part webs 3A, 3B and, if appropriate, also the strand 5, is/are guided over transversely displaceable rolls, with the aid of which the path length to be run through from the press unit 1 as far as the knife cylinder 7 can be varied specifically. Another possibility is to adjust the rotational angle of the impression cylinders of the press unit 1 by temporarily adjusting the speed, to displace the printed image with respect to the position of the cut with a constant path length from the press unit 1 to the knife cylinder 7. The latter type of adjustment has the advantage that additional cut register setting elements are not needed for all the part webs but only for the part webs turned in the turner unit 4. The applicability of the method according to the invention specifically does not depend on the type of setting elements with which the cut register setting is implemented but, in the following text, the use of the press unit 1 for cut register setting will be assumed.

In order to control the cut register, before running into the folding unit, that is to say before the combining of the part webs to form a strand 5, an optical sensor 8 which registers the position of a cut register mark on the part web 3A, 3B is provided for each part web 3A, 3B. For example, the knife cylinder 7 can be equipped with an incremental encoder which supplies a clock signal having a predetermined number of pulses and one reference pulse per revolution of the knife cylinder. In this case, when the cut register mark occurs at the sensor 8, the number of such pulses generated up to that point since the last reference pulse can be used as a measure of the position of the cut register mark. A position of the cut register mark measured in this way represents a measure of the actual value of the position of the cut, that is to say of the spacing to be expected of the cut from the mark, and can be used to control the cut register of the respective printing material web.

The path of the printing material web 2 or the part webs 3A, 3B cut therefrom from the press unit 1 as well as the location of the cut register measurement by the sensor 8 is marked as L1 in FIG. 1. The path of the printing material in the form of the strand 5 from the location of the cut register measurement by the sensor 8 as far as the knife cylinder 7 is marked as L2 in FIG. 1.

It goes without saying that, if the measured signal M from the sensor 8 is used as an actual value of the position of the cut in a control loop for cut register control, a systematic error is perpetrated, in that the contribution of the portion L2 of the path to the cut register error is not taken into account. Since the path L2 in practice quite possibly has a similar length to the path L1, the effectiveness of such cut register control is necessarily restricted from the start.

Figure 2:
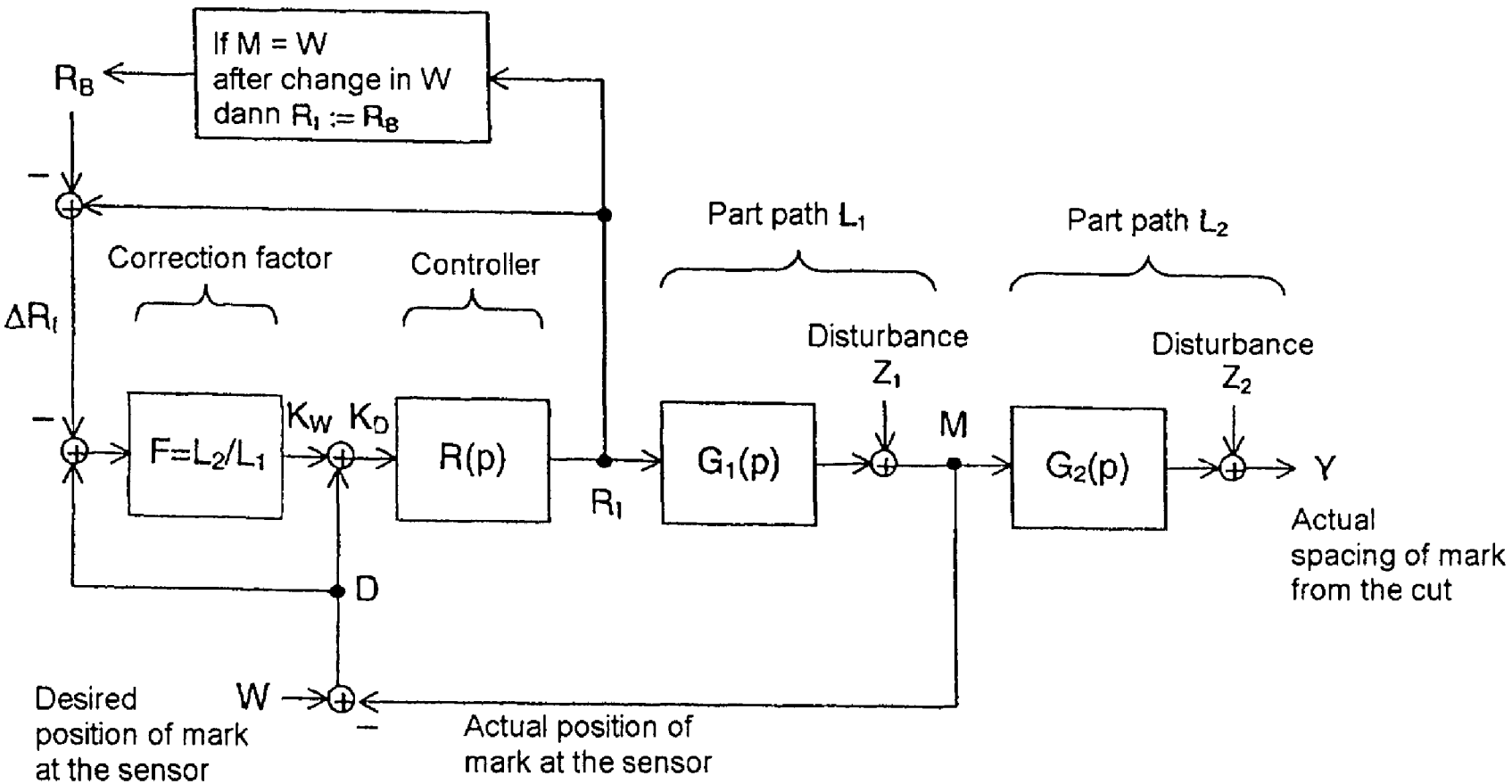
FIG. 2 is a control signal flowchart illustration of the method according to the present invention.

The procedure according to the invention for improving the cut register control on the basis of registering an actual value before the folding unit corresponding to FIG. 1 is illustrated in FIG. 2 in the form of a control engineering signal flowchart, which shows an individual control loop. In this case, such a control loop is provided for each part web 3A, 3B.

In FIG. 2, G1($p$) designates the transfer function of the portion L1 of the path. The input signal of this transfer element G1($p$) is the set value RI of the cut register. Along the portion L1 of the path, the printing material web is subject to disruptive influences which, in particular during a change in the operating speed of the press, lead to a dynamic displacement of the position of the cut. These disruptive influences are taken into account in FIG. 2 by the addition of a disturbance Z1 to the output signal from the transfer element G1($p$). The superimposition of the output signal from G1($p$) and Z1 results in the measured value M for the position of the cut, which is supplied by the optical sensor 8 arranged between the turner unit and the folding unit.

The portion L1 of the path is followed by the portion L2 of the path in the folding unit. In FIG. 2, the transfer function of the portion L2 of the path is designated G2($p$). The input signal of this transfer element G2($p$) is the aforesaid measured value M for the position of the cut at the end of the portion L1 of the path. The printing material web having the measured value M is subject to further disruptive influences along the path L2 which, in particular in the event of a change in the operating speed of the press, lead to a further dynamic displacement of the position of the cut. These further disruptive influences are taken into account in FIG. 2 by the addition of a further disturbance Z2 to the output signal of the transfer element G2($p$). The result of this addition is the actual distance Y of the cut register mark from the cut on the knife cylinder 7.

In a conventional control loop for cut register control, the measured value M registered by the sensor 8 is subtracted from the desired value W of the position of the cut, which can be set by the printer, and the control difference D formed in this way is supplied to a controller having the transfer function R(p). In this case, the aforesaid desired value W is the position of the cut register mark on the measured printing material part web 3 in relation to the rotational angle position of the knife cylinder 7. The control correction value KW which, according to FIG. 2, is added to the control difference D, is equal to zero in the conventional control loop considered hitherto, that is to say the branches of the signal flowchart according to FIG. 2 used to form the control correction value KW do not exist there. The output signal of the controller R(p) is the instantaneous set value RI of the cut register setting element which, in the example considered, as mentioned, is formed by the press unit 1 itself for the straight-ahead part web 3A and, for the turned part web 3B, is formed by an additional setting element not shown in the figure.

It is clear that the conventional control loop described above is aimed at maintaining agreement between the measured value M and the desired value W, so that the error of the actual distance Y between the cut register mark and the cut on the knife cylinder 7 is determined substantially by the contribution of the disturbance Z2 of the portion L2 of the path. In practice, however, the portion L2 of the path is of the same order of magnitude as the portion L1 of the path, and this is also true of the respective disturbance contributions Z1 and Z2, so that the effectiveness of the control system overall is definitely in need of improvement.

According to the invention, it is now assumed that the contribution of the portion L2 of the path to the cut register error has a fixed ratio F to that of the portion L1 of the path, and that this ratio F is even given approximately by the length ratio L2/L1. The result of this is that, doing a measurement of Y instead of M, an existing control difference W−Y would be greater overall by the factor 1+L2/L1 than the difference D=W−M. While maintaining the measurement of M, this can be taken into account by using only mathematical additional operations in the control loop, which are represented in the signal flowchart of FIG. 2 as an additional signal path, by means of which an additional contribution having the value F·D=(L2/L1)·D is generated from the conventional control difference and is added to D.

Were the control correction value designated KW in FIG. 2 to be added to D to be formed on its own in the manner previously described, that is to say without the signal flow branches illustrated in FIG. 2 above the two transfer elements F=L2/L1 and R(p), then the result would be a potentially unstable behaviour of the control loop. If, for example, L2/L1=1 is assumed and thus Z1=Z2, then the result in the event of the occurrence of a disturbance Z1=Z2 for the corrected control difference KD would initially be a value KD=2D=−2Z1 and, from this, a control of the set value RI of the cut register to twice that value which would be needed for a control difference D=0. This would result in a control difference D just as large as the original but with opposite sign. This would in turn lead to a corresponding overcontrol of RI in the other direction, which would cause an oscillation in the control loop, in which the error in the actual position of the cut Y would fluctuate between zero and 2Z1. It goes without saying that such oscillations could potentially also increase in amplitude.

To avoid this, from that proportion of the control difference D which, weighted by the correction factor F=L2/L1, is added to the uncorrected control difference D, the previous change ΔRI of the cut register set value RI is subtracted before the weighting. In this case, the previous change ΔRI means the difference between the current value of RI and a reference value RB, which is the value of RI at the first time at which the measured value M agreed with the desired value W after a change to the desired value W.

In the previous example with L2/L1=1, in a steady state with M=W, RB would equal RI, therefore ΔRI=0. In the event of a disturbance Z1=Z2, after an initial overcontrol of RI on account of KD=2D=−2Z1, a value ΔRI=−2Z1 would be present. Although the overcontrol of the controller would initially cause, as previously mentioned, just as large a control difference as the original but with opposite sign, the formation of the difference D−ΔRI before the weighting with the factor L2/L1 would now compensate for the overcontrol of D, so that the build-up of an oscillation in the control loop is prevented. Here, the value ΔRI includes the corrections to the cut register setting RI already carried out by the control loop.

The set value RI of the cut register must also change when the desired value W is changed. However, this does not constitute any reaction of the control loop to disturbances Z1 and Z2, for which reason, after the transient response to a steady state following a change of W, the new value of RI is stored as the reference value RB of the cut register setting for the further control.

As those skilled in the art will know, the preceding stability considerations do not take into account the dynamic characteristics of the transfer elements R(p) and G1(*p*) involved. To this extent, they are highly simplified and should therefore not be understood as a complete stability analysis of the control loop. Instead, they are in principle intended only to explain the sense in subtracting the corrective term ΔRI.

Figure 3:
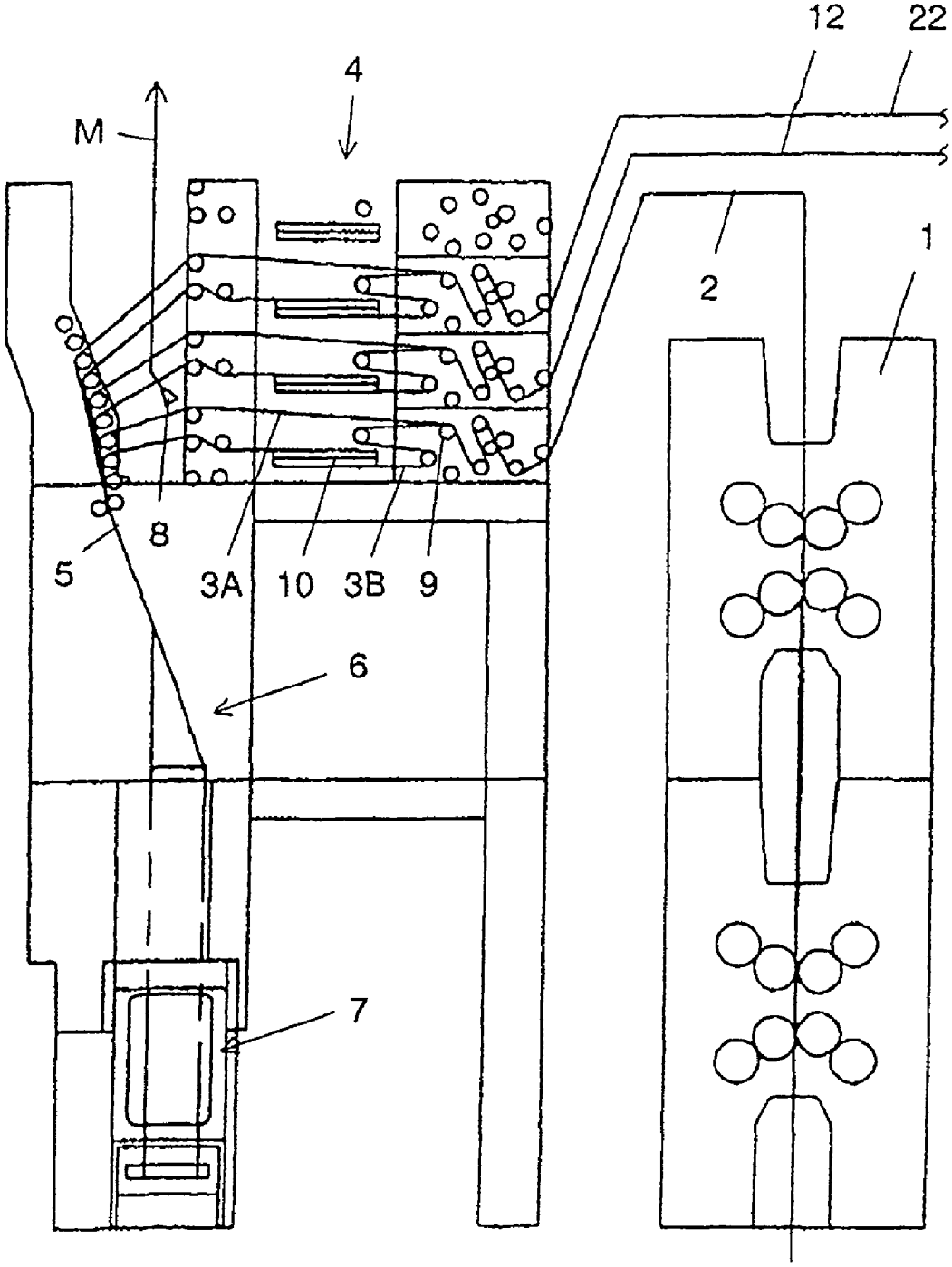
FIG. 3 is a schematic partial side view of a press corresponding to an embodiment of the present invention.

In order to illustrate a further aspect of the invention, FIG. 3 shows a schematic partial side view of a press, that is to say an enlarged detail from FIG. 1, in which details of the turner unit 4 and of the folding unit can be seen, specifically in accordance with a first embodiment of the invention. The reference symbols of FIG. 3 correspond to those of FIG. 1, only one press unit 1 being illustrated, in which the printing material web 2 is printed. Two further printing material webs 12 and 22 come from further press units, not illustrated, which are located on the right beside the press unit 1. Because of the basic agreement of the illustration of FIG. 3 with that of FIG. 1, a renewed description of the elements contained therein and already explained by using FIG. 1 is rendered superfluous.

The printing material web 2 is cut along the length on a longitudinal cutting cylinder 9 into two part webs 3A and 3B, namely a straight-ahead part web 3A and a turned part web 3B. The straight-ahead part web 3A runs directly into the folding unit, while the turned part web 3B is first deflected in the turner unit 4 on turner bars 10, indicated schematically, and is turned as a result before being fed to the folding unit. It is clear that the path of the turned part web 3B in the turner unit 4 is as a result considerably longer than that of the straight-ahead part web 3A, and that the turned part web 3B is subjected to additional frictional forces and, consequently, to greater stretch by the deflection on the turner bars 10.

To measure a cut register mark on the straight-ahead part web 3A, a sensor 8 already shown in FIG. 1 is arranged after the turner unit 4 and supplies a measured value M for the position of the cut in the straight-ahead part web 3A. Identical sensors are also provided for the straight-ahead part webs of the further printing material webs 12 and 22, which are likewise cut longitudinally, but are not shown in FIG. 3 for reasons of clarity.

To control the position of the cut of all the part webs, exactly the same number of sensors 8 as part webs and exactly the same number of individual control loops would be needed. However, if the additional contribution to the cut register error experienced by a turned part web 3B in comparison with the associated straight-ahead part web 3A is predictable, then it is sufficient to measure only the position of the cut mark on the straight-ahead part web 3A and to correct the cut register setting of the turned part web 3B in accordance with the aforementioned prediction with respect to that of the straight-ahead part web 3A, in order to achieve adequate accuracy of the position of the cut in both part webs 3A and 3B.

As a rule, it is assumed that the additional stretch of the turned part web 3B in the turner unit 4 has a fixed relationship with the stretch of the straight-ahead part web 3A between the longitudinal cutting cylinder 9 and the sensor 8, so that the aforesaid correction can be carried out simply and, for example, can consist in the addition of a corrective value that is constant or linearly dependent on the cut register setting of the straight-ahead part web 3A.

It goes without saying that different cut register settings for the straight-ahead part web 3A and for the turned part web 3B require separate setting elements for the two part webs. This can be implemented, for example, by the straight-ahead part web 3A being adjusted on its own by means of the impression cylinders of the press unit 1 and, for the correction of the turned part web 3B, a displaceable register roll being provided as an additional adjusting element, by means of which a setting differing from the straight-ahead part web 3A can be made for the turned part web 3B.

If, instead of a sensor 8 and a dedicated control loop for each part web, only a single sensor 8 and a single control loop with correction for each printing material web 2, 12, 22 is needed, then this means overall a considerable reduction in the expenditure on sensors and signal processing technology. This prediction of the additional error contribution of the turner unit 4 in the case of the turned part web 3B can be combined with the previously mentioned prediction of the error contribution of the folding unit in all the part webs, but can also be applied independently of the latter.

Not illustrated by an individual figure is an aspect of the invention which relates to complex folding units having a plurality of former levels following one another. In this case, the extent of the necessary correction of the cut register set value obviously also depends on the former level at which a printing material web or part web runs into the folding unit, so that the former level has to be incorporated in the determination of the correction. In this case, the previously described path-length-dependent correction already takes the former level into account implicitly, in that the path length in the folding unit of course depends on the former level at which a printing material web or part web runs into the folding unit.

A correction depending specifically on the former level can be added both as an additional measure as required to a path-length-dependent correction and also replace such a correction for the purpose of simplification. In the simplest case, a manually adjustable correction value is provided for each former level, which is added to the set value of the cut register of all the printing material webs running over the respective former level. The former-level-specific correction value could, however, also be chosen in functional dependence on the cut register settings of the printing material webs running over the respective former level. In particular, it could be a linear function of the respective cut register setting.

Figure 4:
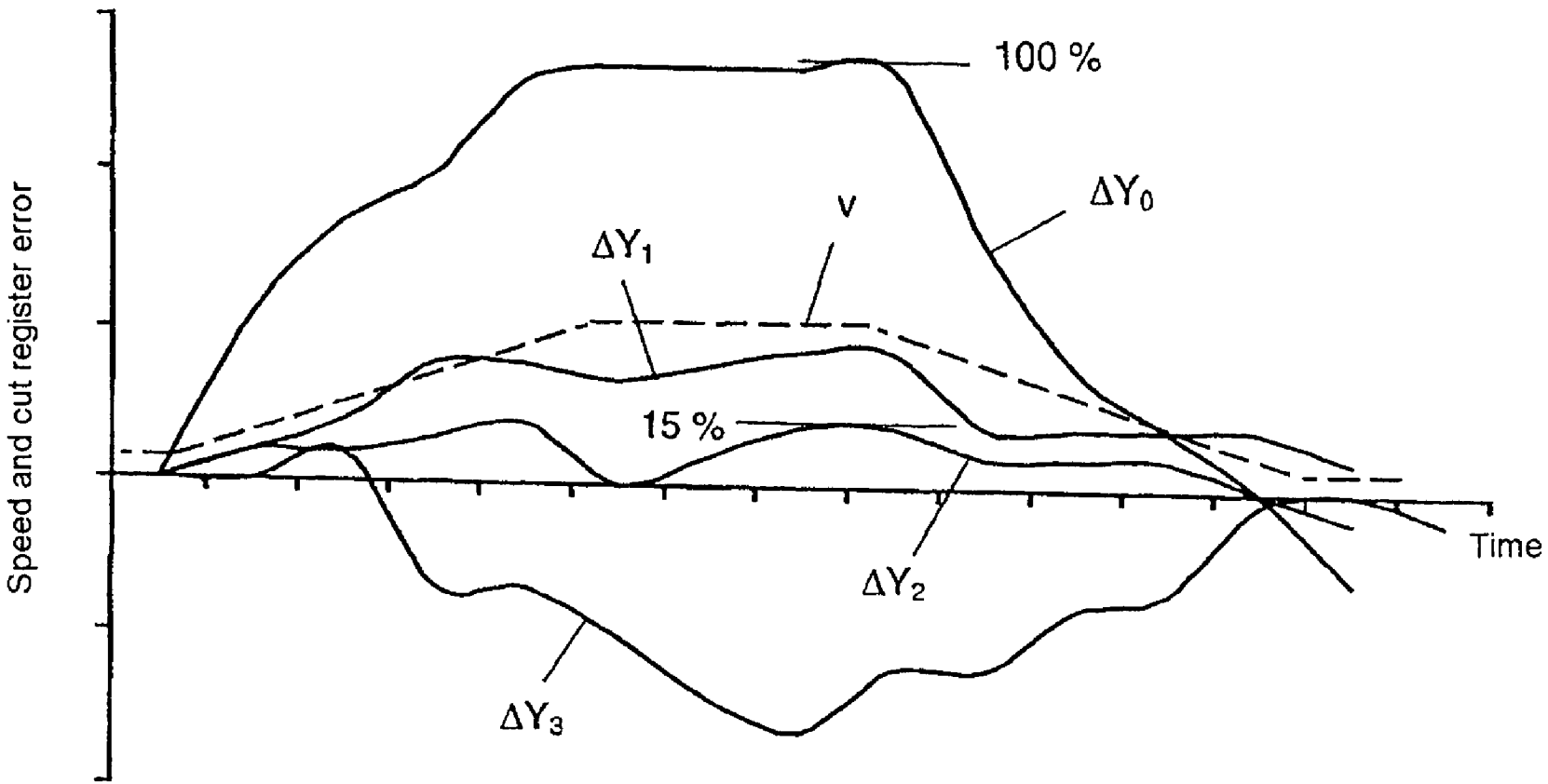
FIG. 4 is a graph showing time curves of the cut register error in the event of a variation in the speed of a press for various control loop settings.

The action of the method according to the invention is illustrated by FIG. 4, in which, by way of example, some time curves measured during the testing of the present invention of the cut register error for a typical speed profile of the operation of a press are reproduced with linear scaling. Here, the aforesaid speed profile is plotted dashed and designated v. It starts from a relatively low speed, namely the setup speed of the press, then rises linearly to the continuous printing speed of the press, remains constant at the latter for a certain time and then falls linearly again as far as the setup speed.

The curve designated ΔY0 shows the time curve of the cut register error which results with the speed profile v when no kind of countermeasures are applied. It can be seen that the error rises nonlinearly during the linear speed rise, flattens out after reaching the phase of constant continuous printing speed and likewise remains at least approximately constant, falls nonlinearly during the linear speed fall and changes into the negative area approximately when the setup speed is reached again.

The curve identified by ΔY1 shows the time curve of the cut register error which results with the speed profile v when a conventional control system with actual value measurement before the folding unit is applied without taking any account of the error contribution of the folding unit. This conventional control system would correspond to a weighting factor F=0 in the illustration of FIG. 2. The maximum value of the error which occurs is only about 35% of that which is to be observed on the curve ΔY0 without any control, but the worth of improving this result is obvious.

The curve designated ΔY2 shows the time curve of the cut register error which results with the speed profile v when a control system according to the invention with actual value measurement before the folding unit and account taken of the error contribution of the folding unit by means of a correction according to FIG. 2 with a weighting actor F=L2/L1 corresponding to the ratio of the portions L1 and L2 of the paths of the printing material in the press is applied. In the example considered, the weighting factor F=L2/L1 has a value of about 0.35. It shows that the maximum value of the cut register error has been reduced considerably by the invention as compared with the conventional control system, namely to only about 15% of that of the curve ΔY0 that applies without control.

The curve identified by ΔY3 shows the time curve of the cut register error which results with the speed profile v when a control system according to the invention with actual value measurement before the folding unit and account taken of the error contribution of the folding unit by means of a correction with a false weighting factor F is applied. In the case of the curve ΔY3, the weighting factor F does not correspond to the ratio L2/L1 of the portions L2 and L1 of the paths of the printing material in the press, but is considerably greater than this ratio, namely twice as large. This means that the curve ΔY3 illustrates the effect of a false configuration of the control loop from FIG. 2. In this case, as compared with the operation without control, the result is a maximum value of the cut register error of about −50%, which is poorer in terms of magnitude than the value achieved with a conventional control system in the case of the curve ΔY1.

The courses of the curves shown above in FIG. 4 should be understood as purely exemplary. In particular, the course of the uncontrolled dynamic cut register error ΔY0 with a given course of the operating speed v depends on the press considered and on the printing material. In this case, qualitative differences in the shape of the curve ΔY0 are also possible, which, of course, also result in qualitative differences in the shape of the other curves. However, the basic effectiveness of the invention, which is clearly proved by the trial results illustrated in FIG. 4, does not depend on a specific curve shape of the uncontrolled dynamic cut register error ΔY0.

The application of the method according to the invention to the folding unit, as compared with a conventional cut register control system which does not take any account of the folding unit, requires only a little additional effort, which, in the case of a digital implementation of the control loop, is predominantly in the area of programming. The application of the invention to the turner unit even produces a considerable reduction in effort as compared with a conventional cut register control system in which cut register marks are measured on all the part webs.

Figure 5:
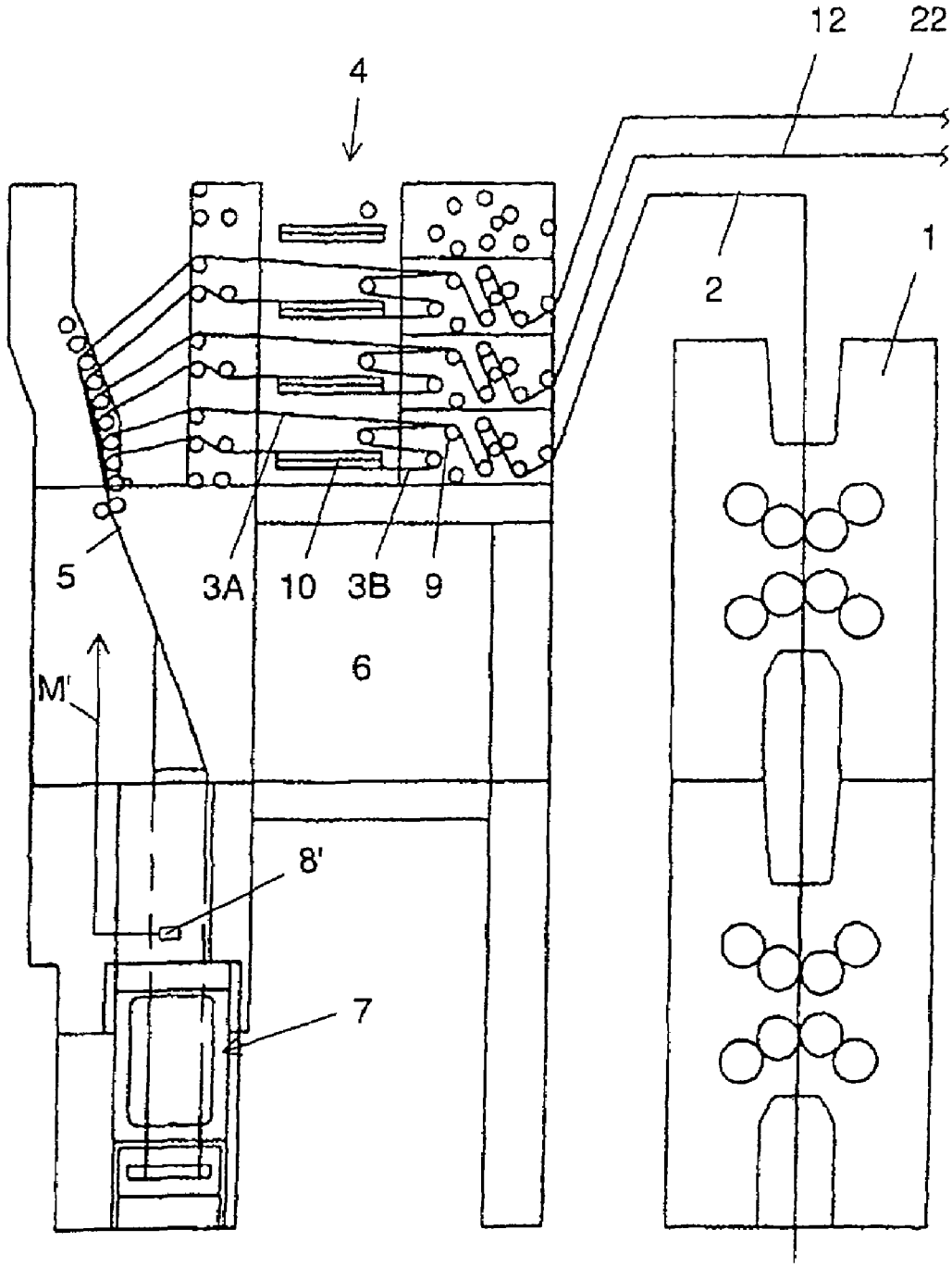
FIG. 5 is a schematic partial side view of a press corresponding to another embodiment of the present invention.

FIG. 5 shows a schematic partial side view of a press according to a second embodiment of the invention, which is largely the same as the first embodiment illustrated in FIG. 3, so that a renewed description of the elements contained therein and already explained by using FIG. 3 is superfluous and only the differences need to be explained. As far as possible, the reference symbols of FIG. 5 correspond to those of FIG. 3.

As opposed to the embodiment of FIG. 3, the embodiment of FIG. 5 includes only a single sensor 8' to measure a cut register mark. The single sensor 8' is arranged shortly before the knife cylinder 7 which supplies a measured value M' for the position of the cut in the outermost web of the entire folded strand 5. Further cut position sensors are not provided.

On the assumption that the turned part web 3B emerging from the printing material web 2 forms the outermost layer of the strand 5, on which the cut register mark registered by the sensor 8' is printed, the measured mark position can be used directly as actual value of the position of the cut only for the control of the cut register of this part web 3B. However, the total length of the path of the part web 3B from the press unit 1 as far as the knife cylinder 7 is known. The difference in the length of the paths covered by the other part webs in the press from the path length of the part web 3B is also known.

If, to a first approximation, it is assumed that the entire stretch of a part web is proportional to its path length, then, from the cut register error measured on the outer part web 3B with the aid of the sensor 8', it is possible to predict the cut register error of each other part web in a simple manner, that is to say on the basis of a linear relationship. Thus, the cut register error of the other part web 3A cut from the same web 2 is smaller, since its path is shorter, while the errors of all the other part webs are greater, since the webs 12 and 22 from which these part webs are cut come from press units which are further removed, not illustrated in FIG. 5, and consequently have a longer path, provided that the distance of the further press units from the press unit 1 is greater than the additional portion of the path of the turned part web 3B as compared with the straight-ahead part web 3A.

Of course, the accuracy of the mathematical model can be increased if required as compared with the linear approach mentioned previously by means of nonlinear terms, for example in the form of a polynomial expression.

In any case, the reduction in the cut register sensors to only a single sensor 8' on the knife cylinder 7 provides an enormous saving in expenditure on hardware, while the mathematical modeling of the dependence of the cut register error of the unmeasured part webs on the error measured on the part web 3B by the single sensor 8' lies purely in the area of software and is therefore easily be adapted to different types of presses. To this extent, the embodiment according to FIG. 5 is of special interest for applications in which extremely high accuracy is less important than low costs.

Figure 6:
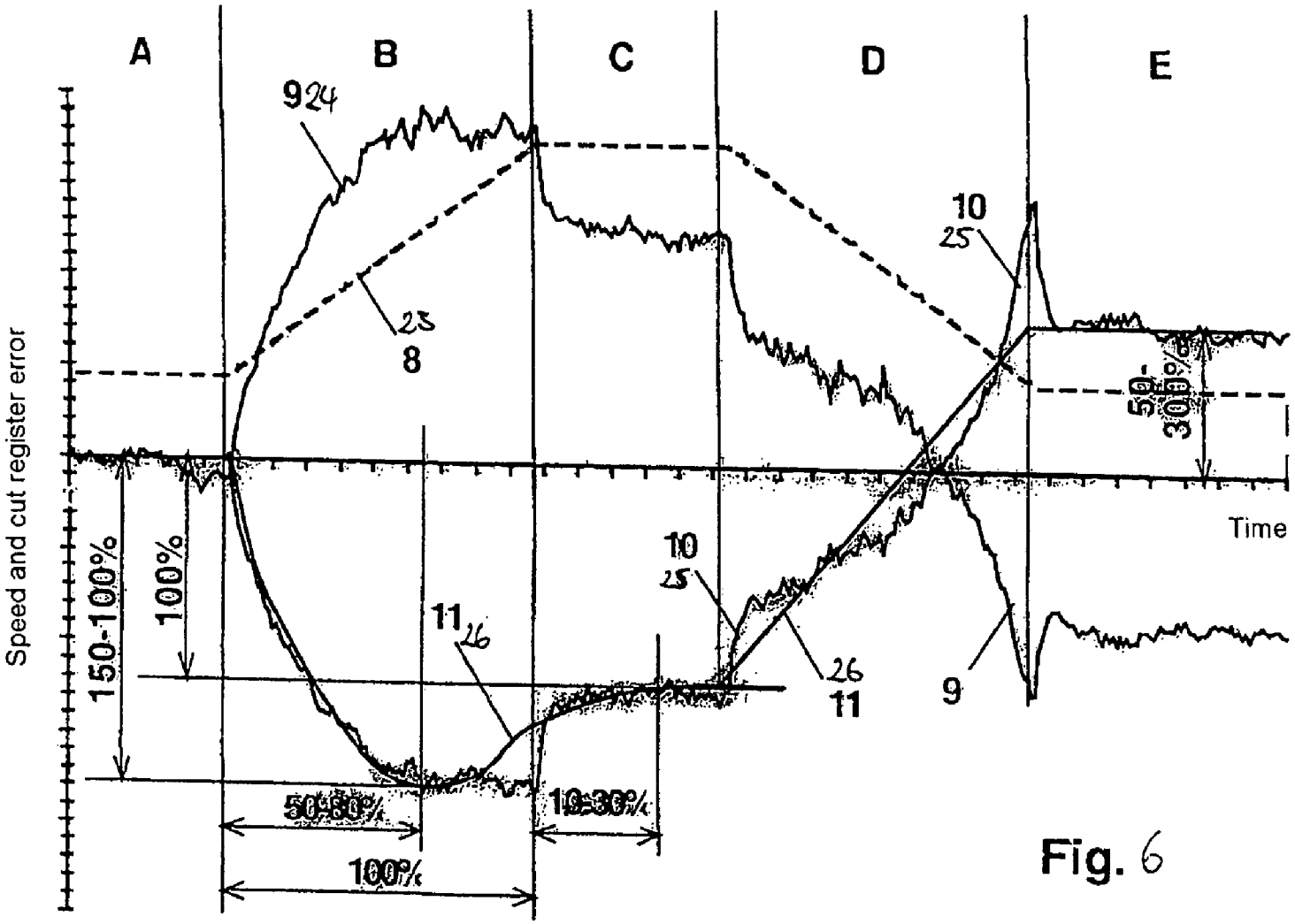
FIG. 6 is a graph showing the time curve of the operating speed, of the cut register error and of the cut register setting according to one embodiment.

FIG. 6 is a graph showing a speed curve of the speed of operation of the rotary press from setup operation via continuous printing until the press is run down. In setup operation, a press normally runs at a relatively low speed in order to keep the accumulation of rejects low. Once the machine, i.e., press, has been set up, the speed is increased to the continuous printing speed of the machine, it not being possible for this increase to be made abruptly but continuously with a normally constant rate of rise fixedly predefined by the electronic control system of the machine. The above-described time curve of the operating speed of a press is reproduced by the dashed curve 23 in FIG. 6, the phase of constant setup speed being identified by A and the phase of linear speed rise being identified by B. The scaling of the two axes is linear in FIG. 6.

Once the continuous printing speed has been reached, it is maintained in a phase C until a predefined number of printed products has been produced. This phase C is illustrated as highly shortened in FIG. 6 compared with an actual printing operation. After phase C is completed, the speed is then reduced in a phase D with a constant rate of fall fixedly predefined by the electronic control system of the machine until a predefined end speed, which normally corresponds to the setup speed, and therefore the last operating phase E has been reached.

If the cut register control is carried out at the setup speed and then maintained during the variation described above of the speed during the phases B to E, then the result is a cut register error, that is to say a deviation of the position of the cut from its desired value, as shown by the curve 24 in FIG. 6. The scaling in FIG. 6 is also linear with regard to the cut register.

As long as the setup speed has not yet been left, the cut register error is virtually zero, that is to say, in phase A it is possible to detect only slight fluctuations of the curve 24 close to the zero position. During the rise in the speed in phase B, the cut register error rises sharply, its time curve being distinctly nonlinear and distinctly flattening off as the rise period increases, in spite of the rate of rise of the speed remaining constant.

At the transition from the speed rise to the phase C of constant continuous printing speed, the cut register error falls virtually abruptly by a certain amount to below the value reached at the end of phase B and then remains virtually constant during phase C, apart from slight fluctuations which are comparable with those in phase A. As mentioned previously, the phase C is illustrated as highly shortened in FIG. 6 but, in view of the approximate constancy of the cut register error in this phase, this plays no part in the understanding of the invention.

If the speed is reduced in phase D at a constant rate of fall, starting from the constant value of phase C, then the cut register error likewise falls but by no means inversely with respect to its course during the rise in speed but substantially faster. Here, even the zero line is undershot and the cut register error reaches a negative value at the end of phase D, of which the magnitude is of the same order of magnitude as the approximately constant positive value in phase C. To a first approximation, the course of the cut register error in phase D can be considered to be linear.

When the speed has reached its end value and is kept constant again in phase E, then initially an abrupt reverse in the magnitude of the cut register error is to be observed, which then again remains virtually constantly at a value which is now negative. This applies even if the end speed corresponds to the initial speed. The press is therefore a time-variant system in relation to the cut register error.

The basic idea of this embodiment of the present invention is based on the fact that the cut register error, which has been set to the value zero in phase A by the operator of the machine, is compensated for, that is to say is kept approximately at the value zero, by varying the cut register setting is varied in accordance with the negative value of the curve 24 previously determined empirically, during the passage through a predefined time curve of the machine speed. This mirroring of the curve 24 on the time axis is illustrated in FIG. 6 as the curve 25.

Since the curve 24 is doubtless subject to certain stochastic fluctuations, it would not be practical to use the negative measured curve 25 actually to compensate for the cut register error. Instead, the curve 25 is described relatively accurately by a mathematical approximation function, which is defined in clearly distinguishable sections in accordance with the subdivision of curves 23 and 24.

In FIG. 6, such an approximation function is drawn in by way of example as curve 26. This approximation function 26 is equal to zero in phase A, has a curved course in phase B and at the start of phase C, which has a maximum in terms of magnitude within phase B. The approximation function 26 is in each case approximated with good accuracy by, for example, a cubic polynomial. In the course of phase C, it changes to a constant value which, in the real printing operation, lasts for a relatively long time as compared with the curved initial region of this phase. In phase D, the approximation function 26 runs linearly, changing its sign. At the start of phase E, it changes to a constant value again, which is maintained as long as necessary.

In FIG. 6, purely by way of example, some guide values for parameters for characterizing the curve 26 are indicated. For example, the time period from the start of phase B to the maximum of the magnitude is about 50-80% of the total duration of phase B. The transition region at the start of phase C until a constant value is reached is about 10-30% of the length of phase B. The height of the maximum of the magnitude in phase B is around 100-150% of the constant value reached in the course of phase C. The height of the constant end value with inverse sign in phase E has a magnitude in the range from 50-300% of the constant value achieved in the course of phase C. The range in which the slope of the curve 26 lies within phase D results in a clear manner from the remaining parameters.

Figure 7:
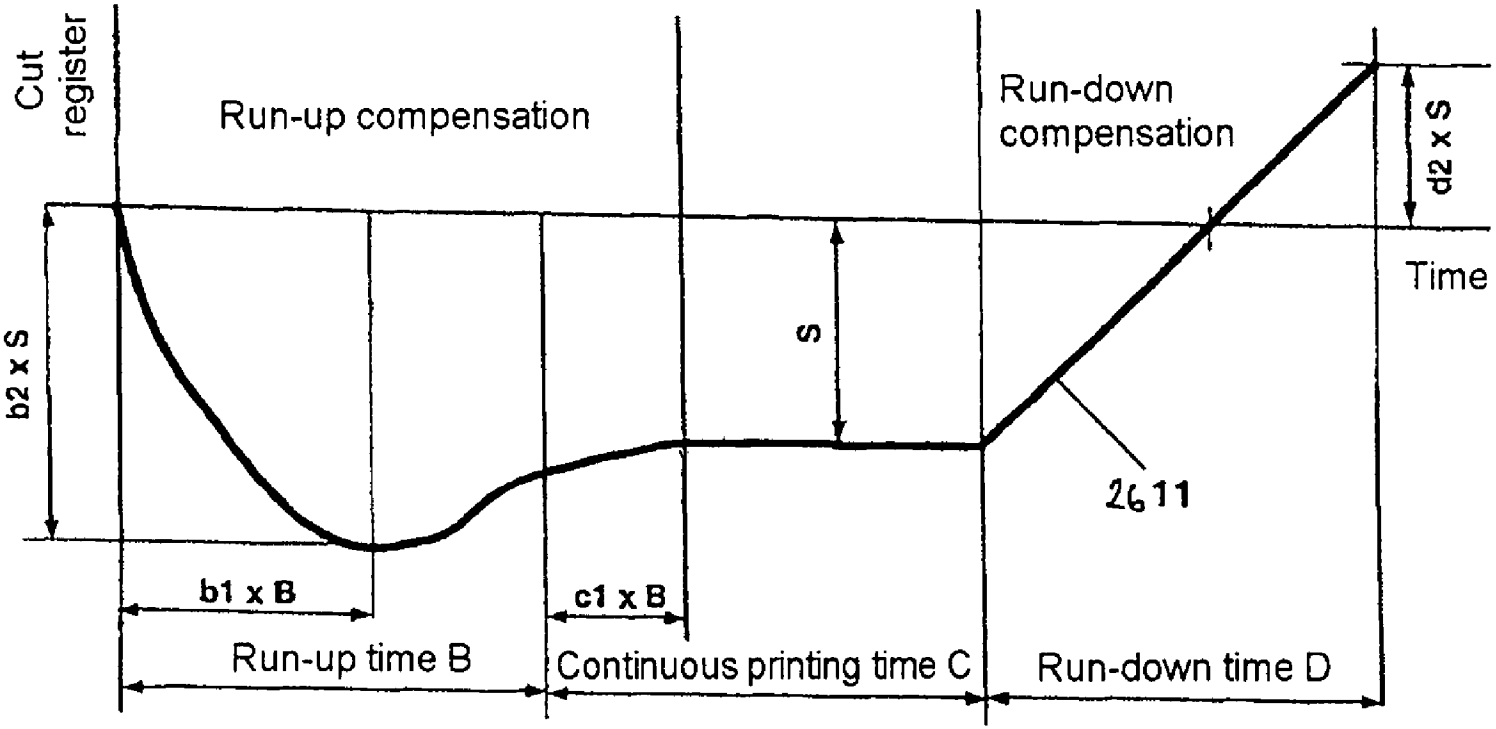
FIG. 7 is a graph showing the time curve of the cut register setting according to the embodiment of FIG. 6 in the form of an approximation curve.

For the purpose of illustration, the compensation curve 26 for the phases of running up B, of continuous printing C and running down D are illustrated once more on their own in FIG. 7. If the basic course of the curve 26 is fixed in the form of a function defined section by section by using compensation polynomials for the phase B and the initial region of phase C and straight line portions for the remaining region of phase C and phase D, then the compensation curve 26 can be described completely by a total of five parameters. These are the position of the maximum of the magnitude in phase B as a proportion b1 of the total run-up time B, the duration of the transition in phase C as a proportion c1 of the total continuous printing time C, the value S of the cut register setting in the steady-state region of the continuous printing time C, the ratio b2 of the height of the maximum of the magnitude of the cut register setting in phase B to the value S, and also the ratio d2 of the end value of the cut register setting at the end of phase D to the value S. In this case, b2>1 and d2<0.

It should be noted that, for the purpose of the mathematical description of the compensation curve 26, a total of more than the aforementioned parameters are needed if phase B and the initial region of phase C are represented, for example, by two cubic polynomials. The adaptation of all the curve parameters, that is to say all the polynomial coefficients in the case of polynomials, to the aforementioned selectable parameters can, however, be carried out automatically by the open-loop or closed-loop control device of the press in accordance with predefined mathematical rules.

If, by means of control measurements during printing operation, the printer establishes that the compensation action is inadequate in one or more phases, that is to say that, in the case of the compensation curve 26 predefined at the start of printing operation, an impermissibly large cut register error occurs, then he can change one or more of the parameters b1, c1, S, b2 and d2 by manual intervention. This change acts directly on the current printing operation and is stored for the next run of the press as a new shape of the compensation curve 26. In this way, the shape of the compensation curve 26 can be made to track slow time changes in the behaviour of the press if required, that is to say the long-term drift of the dynamic cut register error.

It goes without saying that the duration of the setup phase A and the duration of the end phase E are arbitrary, since the compensation only begins with the entry to phase B and, after the end of phase D, the cut register setting d2×S reached there is no longer changed.

The preceding courses of the curves shown in FIGS. 6 and 7 should be understood as purely exemplary. In particular, the course of the dynamic cut register error in the case of a given course of the operating speed depends on the individual press, and also on the printing material and the web path lengths. In this case, not only are quantitative differences in the values of the characteristic parameters possible but also qualitative differences, that is to say a shape of the necessary compensation curve 26 which deviates considerably from the course shown as an example. In any case, however, it can be assumed that the shape of the curve 24 of the cut register error for a given speed curve 23 is a reproducible characteristic of the respective press and of the printing material used, and that it can generally be described sufficiently accurately by an approximation function 26 defined section by section.

The method according to the invention can also be applied when a press is to be operated as desired with various rates of rise and fall of the speed and/or with various continuous printing speeds. In this case, an associated compensation function 26 must be stored for every possible speed curve 23, or that present must be expanded differently.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling a cut register in a web-fed rotary press, wherein a plurality of printing material webs are combined into one strand which is cross cut and folded in the web-fed rotary press, said method comprising the steps of:

measuring a position of a cut register mark on a printed material web and thereby registering an actual value measurement of the position of the cut register mark on the printed material web;

using the registered position in a control loop as an actual value of the positions of the cut register mark for cut register control; and correcting, in the control loop, a first set value of a cut register setting element assigned to the printing material web based on a mathematical model to approximately compensate for an error contribution of a proportion of the path of the printing material web that is not registered by the actual value measurement, the first set value being the value necessary to achieve a control difference of zero, the control difference being the difference between the measured actual value of the position of the cut and a desired value of the position of the cut.

2. The method of claim 1, wherein the mathematical model provides a linear relationship between the error contribution of the proportion of the path of the printing material web in the press not registered by the actual value measurement and the control difference between the measured actual value assigned to the printing material web and the desired value.

3. The method of claim 1, further comprising the step of adding, in the control loop, a control correction value to the control difference, wherein the control correction value is calculated by multiplying a difference between the uncorrected control difference and a corrective term derived from the instantaneous first set value of the cut register setting element by a fixed correction factor.

4. The method of claim 3, wherein the value of the fixed correction factor depends on a ratio of a first path length of the printing material web between the measurement location of the cut register mark and the location of the crosscut to a second path length of the printing material web between the press unit and the measurement location of the cut register mark.

5. The method of claim 4, wherein the correction factor depends at least approximately on the ratio of the first path length of the printing material web to the second path length of the printing material web.

6. The method of claim 3, wherein the corrective term is the difference between the instantaneous first set value of the cut register setting element and a reference value.

7. The method of claim 6, wherein the reference value is a value of the first set value of the cut register setting element at which, following the last change in the desired value, the control difference reached the value zero for the first time.

8. The method of claim 1, wherein the press unit in which the printing material web is printed is used as a cut register setting element, said method further comprising the step of temporarily changing the rotational speed of impression cylinders of the press unit to adjust the cut register.

9. The method of claim 8, further comprising changing the rotational speed of driven cylinders of all downstream clamping points of the printing material web originating from the press unit at the same time as the speed of the impression cylinders is changed to effect the same change in the circumferential speed.

10. The method of claim 1, wherein the printing material webs are cut along a length into first and second part webs before being combined into the at least one strand, said second part webs are turned in a turner unit, and said step of measuring is performed on the first part web, said method further comprising the step of correcting a cut register setting of the turned second part web with respect to that of the first part web originating from the same printing material web based on a mathematical model for the error contribution of the additional path of the turned second part web in the turner unit.

11. The method of claim 10, wherein the mathematical model for the error contribution of the additional path of the turned second part web in the turner unit provides a linear relationship between the error contribution of the additional path of the turned second part web and the error contribution of the path of the first part web between the location of the longitudinal cut and the measurement location of the cut register mark on the first part web.

12. The method of claim 1, wherein a folding unit of the printing press has a plurality of levels of formers, said method further comprising the step of correcting the first set value of a cut register setting element assigned to a printing material web based on the level in the former through which the printing material web runs in the folding unit.

13. The method of claim 1, further comprising the steps of:

assigning a cut register function to a predetermined speed function, wherein the predetermined speed function describes a time variation of the operating speed of the press starting from a predetermined initial value and the cut register function describes a time variation of a second set value of the cut register; and changing the second set value of the cut register continuously and synchronously in accordance with the associated cut register function during a variation in the operating speed of the press according to the predetermined speed function, the cut register function being chosen empirically such that it counteracts a change in the actual value of the cut position as a result of the change in the operating speed.

14. The method of claim 13, wherein the cut register function is a negative value of a function which describes the time variation of the actual value of the cut position with respect to the value present at the predetermined initial value of the operating speed of the press during a variation in the operating speed in accordance with the predetermined speed function.

15. The method of claim 14, wherein the cut register function is a mathematical approximation function of a function which describes the time variation of the actual value of the cut register mark position.

16. The method of claim 15, further comprising the step of storing at least some parameters of the approximation function in a memory such that the parameters are indicated to an operator of the press and are manually changeable.

17. The method of claim 13, wherein the speed function is subdivided into various characteristic sections, said step of assigning includes assigning each of the characteristic sections of the predetermined speed function to a respective characteristic section of the cut register function.

18. The method of claim 17, wherein the speed function starts from a first section of constant initial speed, successively has a rise in the speed with a constant rate of rise in a second section, constancy of the speed over a third section of variable length but predetermined minimum length, and a fall in the speed at a constant rate of fall in a fourth section, and terminates with a fifth section of constant final speed.

19. The method of claim 18, wherein the cut register function has a constant first value during the first section of the speed function, the cut register function reaches a constant second value during the third section, and in that in the second section, the cut register function has a course which contains a maximum whose magnitude exceeds the constant second value.

20. The method of claim 18, wherein the cut register function has a constant first value during the first section of the speed function, the cut register function reaches a constant second value during the third section and reaches a constant third value during the fifth section, and in that, in the fourth section, the cut register function runs approximately linearly.

21. The method of claim 13, further comprising the step of assigning an individual cut register function to each setting element of the press provided for setting the cut register.

22. The method of claim 13, wherein the first set value is based on the second set value of the cut register.

23. A method for controlling a cut register in a web-fed rotary press, wherein a plurality of printing material webs are combined into one strand which is cross cut and folded in the web-fed rotary press, said method comprising the steps of:

measuring a position of a cut register mark on a first printed material web of said plurality of printed material webs and registering the actual value measurement of the position of the printing cut register mark on the first printed material web;

using the measured position of the cut register mark in a control loop as an actual value of the position of the cut register mark for cut register control of the first printing material web; and calculating, from the registered position of the cut register mark, the actual value of a second printing material web of the plurality of printing material webs for the cut register control of the second printing material web based on a mathematical model which takes into account the differences in the paths of the plurality of printing material webs through the press.

24. The method of claim 23, wherein different lengths of the paths of the plurality of printing material webs through the press are incorporated into the mathematical model as parameters.

25. The method of claim 24, wherein the mathematical model provides a linear relationship between the measured position of the mark of the first printed material web and the calculated actual value of the position of the mark in the second printed material web, wherein the linear relationship is based on the lengths of the path of the first printing material web and the path of the second printed material web.

26. The method of claim 23, wherein a press unit in which the second printing material webs is printed is used as a cut register setting element, said method further comprising the step of temporarily changing the rotational speed of an impression cylinder of the press unit of the second printing material web to adjust the cut register.

27. The method of claim 26, further comprising changing the rotational speed of driven cylinders of all downstream clamping points of the second printing material web originating from the press unit at the same time as the speed of the impression cylinder is changed to effect the same change in the circumferential speed.

28. The method of claim 23, wherein a folding unit of the printing press has a plurality of levels of formers, wherein said method further comprises the step of correcting the first set value of a cut register setting element assigned to a printing material web based on the level in the former through which the printing material web runs in the folding unit.

29. The method of claim 23, further comprising the steps of:

assigning a cut register function to a predetermined speed function, wherein the predetermined speed function describes a time variation of the operating speed of the press starting from a predetermined initial value and the cut register function describes a time variation of a second set value of the cut register; and changing the second set value of the cut register continuously and synchronously in accordance with the associated cut register function during a variation in the operating speed of the press according to the predetermined speed function, the cut register function being chosen empirically such that it counteracts a change in the actual value of the cut position as a result of the change in the operating speed.

30. The method of claim 29, wherein the cut register function is a negative value of a function which describes the time variation of the actual value of the cut position with respect to the value present at the predetermined initial value of the operating speed of the press during a variation in the operating speed in accordance with the predetermined speed function.

31. The method of claim 30, wherein the cut register function is a mathematical approximation function of a function which describes the time variation of the actual value of the cut register mark position.

32. The method of claim 31, further comprising the step of storing at least some parameters of the approximation function in a memory such that the parameters are indicated to an operator of the press and are manually changeable.

33. The method of claim 29, wherein the speed function is subdivided into various characteristic sections, said step of assigning includes assigning each of the characteristic sections of the predetermined speed function to a respective characteristic section of the cut register function.

34. The method of claim 33, wherein the speed function starts from a first section of constant initial speed, successively has a rise in the speed with a constant rate of rise in a second section, constancy of the speed over a third section of variable length but predetermined minimum length, and a fall in the speed at a constant rate of fall in a fourth section, and terminates with a fifth section of constant final speed.

35. The method of claim 34, wherein the cut register function has a constant first value during the first section of the speed function, the cut register function reaches a constant second value during the third section, and in that in the second section, the cut register function has a course which contains a maximum whose magnitude exceeds the constant second value.

36. The method of claim 34, wherein the cut register function has a constant first value during the first section of the speed function, the cut register function reaches a constant second value during the third section and reaches a constant third value during the fifth section, and in that, in the fourth section, the cut register function runs approximately linearly.

37. The method of claim 29, further comprising the step of assigning an individual cut register function to each setting element of the press provided for setting the cut register.

38. The method of claim 29, wherein the first set value is based on the second set value of the cut register.

* * * * *